US006787022B1

(12) United States Patent
Berlowitz et al.

(10) Patent No.: US 6,787,022 B1
(45) Date of Patent: Sep. 7, 2004

(54) WINTER DIESEL FUEL PRODUCTION FROM A FISCHER-TROPSCH WAX

(75) Inventors: Paul Joseph Berlowitz, Glen Gardner, NJ (US); Daniel Francis Ryan, Baton Rouge, LA (US); Robert Jay Wittenbrink, Kingwood, TX (US); W. Berlin Genetti, Baton Rouge, LA (US); Jack Wayne Johnson, Clinton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/562,453

(22) Filed: May 2, 2000

(51) Int. Cl.[7] ..... C10G 65/10

(52) U.S. Cl. ..... 208/18; 208/19; 208/24; 208/28; 208/49; 585/1

(58) Field of Search ..... 44/300; 208/18, 208/19, 24, 28, 49; 585/1; 518/700, 705

(56) References Cited

U.S. PATENT DOCUMENTS

| | | | | | |
|---|---|---|---|---|---|
| 4,544,792 | A | * | 10/1985 | Smith et al. | 585/533 |
| 4,547,601 | A | * | 10/1985 | Holland et al. | 585/310 |
| 4,556,477 | A | | 12/1985 | Dwyer | 208/111 |
| 4,684,756 | A | * | 8/1987 | Derr, Jr. et al. | 585/330 |
| 4,879,428 | A | * | 11/1989 | Harandi et al. | 585/533 |
| 5,059,299 | A | * | 10/1991 | Cody et al. | 208/27 |
| 5,324,335 | A | | 6/1994 | Benham et al. | 44/452 |
| 5,378,348 | A | | 1/1995 | Davis et al. | 208/27 |
| 5,506,272 | A | | 4/1996 | Benham et al. | 518/700 |
| 5,689,031 | A | * | 11/1997 | Berlowitz | 585/734 |
| 5,766,274 | A | * | 6/1998 | Wittenbrink | 44/436 |
| 5,770,542 | A | | 6/1998 | Brandes et al. | 502/527 |
| 5,807,413 | A | * | 9/1998 | Wittenbrink et al. | 44/451 |
| 5,882,505 | A | * | 3/1999 | Wittenbrink et al. | 208/59 |
| 6,013,171 | A | * | 1/2000 | Cook et al. | 208/27 |
| 6,162,956 | A | * | 12/2000 | Berlowitz et al. | 585/14 |
| 6,248,142 | B1 | * | 6/2001 | Caprotti | 44/440 |
| 6,274,029 | B1 | * | 8/2001 | Wittenbrink et al. | 208/15 |
| 6,284,127 | B1 | * | 9/2001 | Cook et al. | 208/27 |
| 6,296,757 | B1 | * | 10/2001 | Wittenbrink et al. | 208/15 |
| 6,309,432 | B1 | * | 10/2001 | Wittenbrink et al. | 44/436 |

FOREIGN PATENT DOCUMENTS

| | | | | | |
|---|---|---|---|---|---|
| EP | 0687289 | B1 | | 12/1998 | C10L/1/22 |
| FR | 2792946 | A | * | 11/2000 | |
| FR | 2792946 | A1 | | 11/2000 | C10G/65/04 |
| WO | WO97/14769 | | | 4/1997 | C10L/1/02 |
| WO | WO 97 14769 | A | * | 11/1997 | |
| WO | WO98/05740 | | | 2/1998 | C10L/1/08 |
| WO | WO98/16597 | | | 4/1998 | C10L/1/18 |
| WO | WO 9816597 | A | * | 4/1998 | |
| WO | WO99/32582 | | | 7/1999 | C10G/65/10 |
| WO | 0948585 | A | * | 10/1999 | |
| WO | WO00/20535 | | | 4/2000 | C10L/1/08 |
| WO | WO0020535 | A | * | 4/2000 | |

OTHER PUBLICATIONS

ACEA, Europia, European Programme on Emissions, Fuels and Engine Technologies, Executive Summary, Jul. 1995, pp. 1–12.

(List continued on next page.)

*Primary Examiner*—Margaret B. Medley
(74) *Attorney, Agent, or Firm*—Charles J. Brumlik

(57) ABSTRACT

A process for the production of a winter diesel fuel from wax containing hydrocarbons produced by the Fischer-Tropsch hydrocarbon synthesis process. A 300° F.+ Fischer-Tropsch fraction is upgraded first by hydroisomerization followed by catalytic dewaxing resulting in a diesel fuel suitable for use as a winter diesel fuel having excellent cold flow properties and reduced emissions.

33 Claims, 1 Drawing Sheet

OTHER PUBLICATIONS

Jimell Erwin et al, "The Standing of Fischer–Tropsch Diesel in an Assay of Fuel Performance and Emissions", Southwest Research Institute, Nov. 26, 1991–Oct. 26, 1993, pp. 1015–1053.

Standard Specification for Diesel Fuel Oils, ASTM D 975–98b, pp. 1–18, 1998.

T. W. Ryan III et al, Southwest Research Institute, "Diesel Fuel Composition Effects on Ignition and Emissions", 932735, pp. 77–94. date unavailable.

K. B. Spreen et al, Southwest Research Institute, "Effects of Cetane Number, Aromatics, and Oxygenates on Emissions From a 1994 Heavy–Duty Diesel Engine With Exhaust Catalyst", 950250, pp. 238–254, date unavailable.

T. L Ullman et al, Southwest Research Institute, "Effects of Cetane Nubmer on Emissions From a Prototype 1998 Heavy–Duty Diesel Engine", 950251, pp. 255–271. date unavailable.

M. Signer et al, "European Programme on Emissions, Fuels and Engine Technologies (EPEFE)—Heavy Duty Diesel Study", 961074, pp. 564–579. date unavailable.

D. J. Rickeard et al, "European Programme on Emissions, Fuels and Engine Technologies (EPEFE). Comparison of Light and Heavy Duty Diesel Studies", 961075, pp. 580–599. date unavailable.

* cited by examiner

WINTER DIESEL FUEL PRODUCTION FROM A FISCHER-TROPSCH WAX

FIELD OF THE INVENTION

This invention relates to the production of fuels from waxy, paraffinic hydrocarbons produced by the reaction of CO and hydrogen, via the Fischer-Tropsch hydrocarbon synthesis process. In particular, this invention relates to a diesel fuel and a process for its production, useful as a winter diesel fuel derived from wax containing Fischer-Tropsch feeds utilizing a multi-zone isomerization process to yield diesel fuels having both excellent low temperature properties and emissions performance.

BACKGROUND OF THE INVENTION

Upon combustion in a vehicular diesel engine, diesel fuels are known to emit undesirable pollutants, for example; solid particulate matter (PM) e.g., soot, as well as gaseous pollutants, e.g., unburned hydrocarbons (HC), carbon monoxide (CO), and nitrogen oxides (NOx). This is especially true during the winter months, as emissions consisting of HC, NOx, CO and particulates are increased due to the cold temperatures. In addition, cold weather operation places a greater strain on the emissions performance of the fuel, especially the cold-start and smoke performance. As a result, seasonal winter diesel fuels are required in much of the world during these cold periods in order to reduce and/or control emissions. In addition to increased environmental standards, winter diesel fuels need exceptional low temperature flow properties, Accordingly, there have been numerous government and industry efforts to design winter fuels for use in the mogas/diesel markets to address the winter emissions quandary. The current results are winter diesel fuels which are traditionally blended with, or consist essentially of kerosene and are characterized by improved cold flow properties.

Fischer-Tropsch fuels are well known as high cetane number fuels. However, due to the highly paraffinic nature of Fischer-Tropsch fuels, these fuels generally possess mediocre to poor cold flow properties, i.e., cloud point and cold filter plugging point. The heaviest paraffin molecules tend to crystallize as wax particles and precipitate above certain temperatures, resulting in high freeze point and/or cloud point. This makes it difficult or even impossible to use such products in many environments. Improving the cold flow properties of these fuels generally leads to decreasing the cetane number as is the case with conventional fuels. As a result, there is a need in the mogas/diesel markets for a high cetane, low cloud/cold filter plugging point (CFPP) diesel which exhibits emissions performance better than that which would be expected from the currently documented government and industry correlations for fuel effects on emissions.

SUMMARY OF THE INVENTION

In accordance with an embodiment of this invention, is provided a novel process for the production of a fuel, useful as a winter diesel fuel, derived from Fischer-Tropsch products, which meets cold flow standards while simultaneously providing superior emissions performance. The process comprises separating the paraffinic, wax containing Fischer-Tropsch product into a 300° F.+ distillate fraction and upgrading the fraction via hydroisomerization and selective catalytic dewaxing to produce a diesel fuel with excellent low temperature properties and reduced emissions.

In particular, a 300° F.+ (149° C.+) fraction derived from the Fischer-Tropsch process is passed into a first reaction zone, of two sequential isomerization reaction zones in a single reaction stage, the first reaction zone comprising a first catalyst containing a suitable hydroisomerization catalyst, to form a first zone effluent. At least a portion of the liquid product from the first zone effluent, preferably the entire liquid product from the first zone effluent, is passed into a second reaction zone, comprising a second catalyst having a catalytic dewaxing functionality, to form a second zone effluent. In the alternative, the second reaction zone may contain a mixture or composite comprising both catalytic dewaxing and hydroisomerization catalysts. The first and second zones may be in the same or separate reaction vessels and preferably both zones are contained in the same reaction vessel. Further, the first and/or second reaction zone may comprise one or more catalyst beds. The second zone effluent comprises an isomerized hydrocarbon product and can be fractionated into desired liquid product fractions, e.g., a 320–700° F. boiling fraction.

By 300° F.+ fraction is meant the fraction of the hydrocarbons synthesized by the Fischer-Tropsch process and boiling above a nominal 300° F. boiling point. At least a portion of the product of the second reaction zone is recovered to produce a middle distillate boiling in the diesel fuel range, i.e., a 320–700° F. boiling fraction. Preferably, the process is conducted in the absence of intermediate hydrotreating, and produces products with excellent cold flow characteristics, i.e., cloud and freeze point, superior smoke point and better than expected emissions characteristics. Such distillate products can be used as diesel fuels or as blending components therefor. Preferably, this isomerized product of the second zone effluent produces a fuel having a T95 (the temperature at which most all the material has boiled oft, leaving only 5% remaining in the distillation pot) greater than or equal to 240° C. (464° F.) but less than or equal to 350° C. (662° F.), preferably a T95 greater than or equal to 245° C. (473° F.) but less than or equal to 340° C. (644° F.), more preferably a T95 greater than or equal to 245° C. (473° F.) but less than or equal to 335° C. (635° F.) and having a cold filter plugging point as determined by IP-309 below about −35° C., more preferably below about −40° C. and contains:

| | |
|---|---|
| paraffins | at least 90 + wt %, preferably at least 95 + wt %, more preferable at least 99 + wt % |
| sulfur | ≦10 ppm (wt), preferably <5 ppm, most preferably <1 ppm |
| nitrogen | ≦10 ppm (wt), preferably <5 ppm, most preferably <1 ppm |
| aromatics | <1%, preferably <0.1% |
| cetane number | >65, preferably >70, more preferably >75 |

In one embodiment the invention comprises a Fischer-Tropsch hydrocarbon synthesis process, in which a synthesis gas comprising a mixture of $H_2$ and CO, react in the presence of a suitable Fischer-Tropsch hydrocarbon synthesis catalyst, to form a hydrocarbon product wherein a 300° F.+ distillate fraction and hydrogen or a hydrogen containing gas is passed into a first reaction zone, having a first catalyst comprising a suitable hydroisomerization catalyst to form a first zone effluent and the total liquid product from the first zone effluent is passed into a second reaction zone having a second catalyst containing either a catalytic dewaxing catalyst, a hydroisomerization catalyst or a mixture thereof, to form a second zone effluent comprising an isomerized hydrocarbon product. A middle distillate fuel, useful as a diesel fuel is recovered from the hydrocarbon product of the second reaction zone.

In this way, good yields of distillate fuels with excellent cold flow properties are produced from wax containing paraffins derived from the Fischer-Tropsch process to produce a full boiling range diesel fuel, preferably a 320–700° F. fraction, with the unique combination of high cetane number, very low cloud and cold filter plugging point (CFPP) performance and full boiling range cut exhibiting superior emissions performance.

Optionally, all or part of the hydrocarbon product recovered from the second reaction zone can be combined or blended and used as a winter diesel fuel. When used as a blend, the product of this invention can be used in relative minor amounts, e.g., 10% or more, for significantly improving the final blended diesel product

DETAILED DESCRIPTION OF THE PREFERRED EMBODIMENTS

Figure 1:
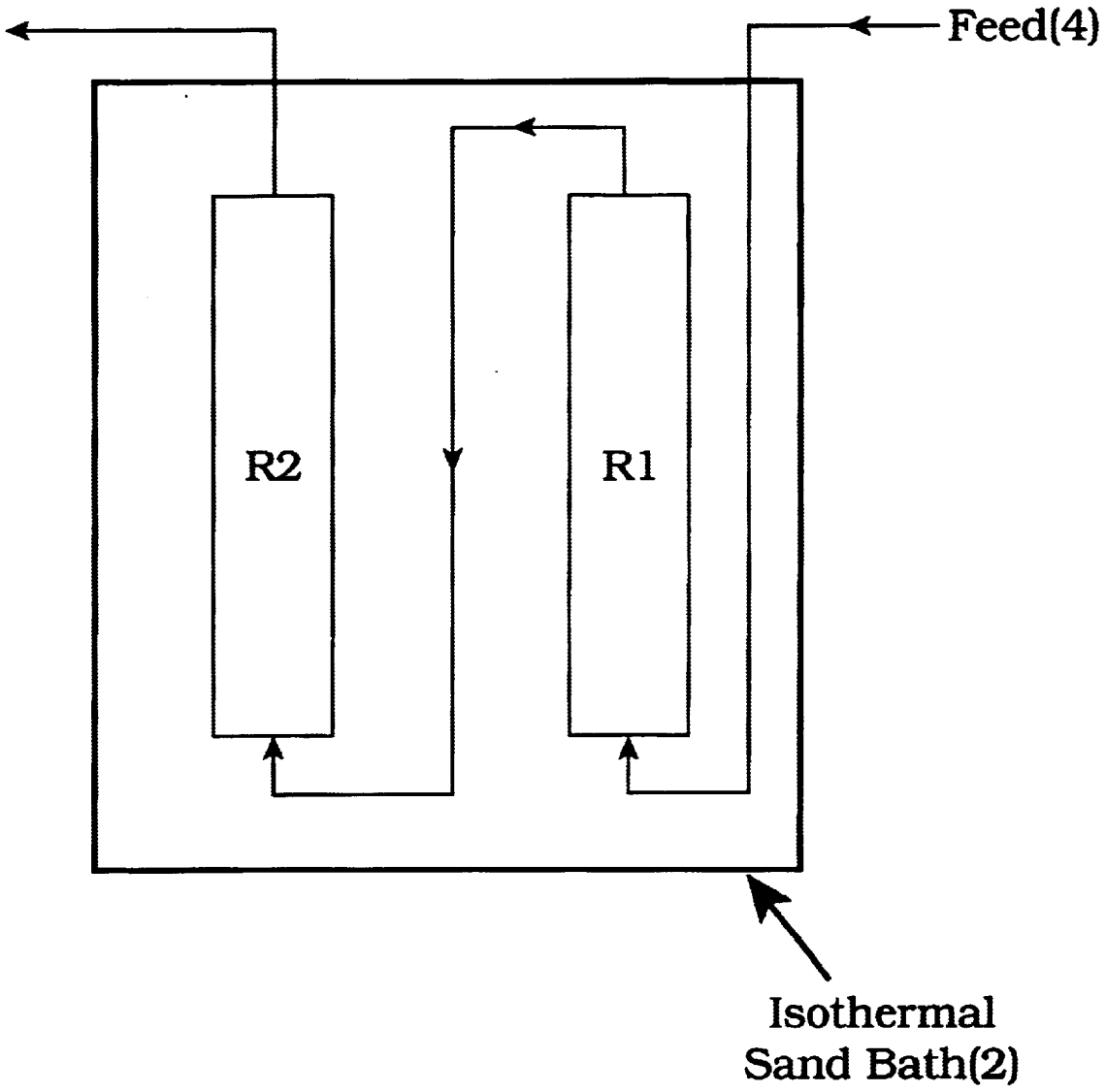
FIG. 1 is an illustration of the experimental reactor used to produce the comparative test fuels of this invention as described in the examples.

The Fischer-Tropsch process is well known to those skilled in the art, see for example, U.S. Pat. Nos. 5,348,982 and 5,545,674 herein a incorporated by reference. Typically the Fischer-Tropsch process involves the reaction of a synthesis gas feed comprising hydrogen and carbon monoxide fed into a hydrocarbon synthesis reactor in the presence of a Fischer-Tropsch catalyst, generally a supported or unsupported Group VIII, non-noble metal e.g., Fe, Ni, Ru, Co and with or without a promoter e.g., ruthenium, rhenium and zirconium. These processes include fixed bed, fluid bed and slurry hydrocarbon synthesis. A preferred Fischer-Tropsch process is one that utilizes a non-shifting catalyst, such as cobalt or ruthenium or mixtures thereof, preferably cobalt, and preferably a promoted cobalt, the promoter being zirconium or rhenium, preferably rhenium. Such catalysts are well known and a preferred catalyst is described in U.S. Pat. No. 4,568,663 as well as European Patent 0 266 898. The synthesis gas feed used in the process comprises a mixture of $H_2$ and CO wherein $H_2$:CO are present in a ratio of at least about 1.7, preferably at least about 1.75, more preferably 1.75 to 2.5.

Regardless of the catalyst or conditions employed however, the high proportion of normal paraffins in the product produced by the Fischer-Tropsch process must be converted from wax containing hydrocarbon feeds into more useable products, such as transportation fuels. Thus, conversion is accomplished primarily by hydrogen treatments involving hydrotreating, hydroisomerization, and hydrocracking in which a suitable fraction of the product is contacted with a suitable catalyst in the presence of hydrogen to isomerize the fraction by converting the molecular structure of at least a portion of the hydrocarbon material from normal paraffins to branched iso-paraffins to form the desired product, as is known to those skilled in the art. Nevertheless, the feedstock for this invention can be described as a wax containing Fischer-Tropsch product, and this product can contain $C_5$+ materials, preferably $C_{10}$+, more preferably $C_{20}$+ materials, a substantial portion of which are normal paraffins. A typical product slate is shown below.

Typical product slate from F/T process liquids:

| | Wt % |
|---|---|
| IBP–320° F. | 13 |
| 320–500° F. | 23 |
| 500–700° F. | 19 |
| 700–1050° F. | 34 |
| 1050° F. + | 11 |
| | 100 |

In accordance with an embodiment of the invention, a wax containing paraffin feed stock derived from the Fischer-Tropsch process is separated, usually by fractionation, into a 300° F.+ distillate fraction. The feed also comprises more than 90% paraffinic hydrocarbons, most of which are normal paraffins. In addition, the feed preferably has negligible amounts of sulfur and nitrogen compounds with less than 2000 wppm, preferably less than 1000 wppm and more preferably less than 500 wppm of oxygen in the form of oxygenates.

Preferably, the 300° F.+ Fischer-Tropsch derived fraction is then upgraded via a single stage isomerization process, i.e., the liquid product of the first reaction zone is passed directly into the second reaction zone, comprising hydroisomerization followed by selective catalytic dewaxing. The single stage reduces product loss and avoids the need for two parallel reactions stages. In particular, the 300° F.+ distillate fraction is passed into a first reaction zone, comprising a hydroisomerization catalyst to form a first zone effluent wherein at least a portion of the liquid product of the first zone effluent is passed into a second reaction zone, comprising a catalyst having a catalytic dewaxing function, to form a second zone effluent comprising a hydroisomerized hydrocarbon product. Preferably, the entire liquid product existing under the conditions of the first reaction zone pass directly into the second reaction zone. However, the first zone effluent may also comprise light gases and naphtha which pass into the second reaction zone. In an alternate embodiment, the light gas and/or naphtha fractions may be separated before the first zone effluent is transferred to the second reaction zone. Further, additional hydrogen or other quench gases may be injected before passing the effluent of the first zone into the second reaction zone.

The Fischer-Tropsch derived wax containing feed is subjected to hydroisomerization in the first reaction zone in the presence of hydrogen, or a hydrogen containing gas, to convert a portion of the normal paraffins to isoparaffins. The degree of hydroisomerization is measured by the amount of boiling point conversion, i.e., the amount of 700° F.+ hydrocarbons converted to 700° F.– hydrocarbons. Following hydroisomerization in the first zone, at least a portion of the liquid product from the first zone effluent is passed into a second reaction zone containing a dewaxing catalyst, a hydroisomerization catalyst or a mixture thereof, designed to minimize boiling point conversion while improving cold flow/cloud point properties by reacting at least a portion of the remaining n-paraffins contained in the first zone effluent to further isomerize the n-paraffins to isoparaffins or crack larger chain paraffins to smaller chain paraffins which are, in turn, isomerized to iso-paraffins or selectively crack the n-paraffins. The dewaxing reaction within the second reaction zone is conducted until a cold filter plugging point for the second zone effluent at or below about −35° C., more preferably below −40° C. is achieved. In the alternative, the dewaxing reaction may be conducted until a cloud point for the second zone effluent at or below about −35° C., more preferably below −40° C. is achieved. Using standard distillation techniques, a hydrocarbon product is recovered from the second zone effluent having a T95 greater than or equal to 240° C. (464° F.) but less than or equal to 350° C. (662° F.), preferably a T95 greater than or equal to 245° C. (473° F.) but less than or equal to 340° C. (644° F.), more preferably a T95 greater than or equal to 245° C. (473° F.) but less than or equal to 335° C. (635° F.). The cold flow and emission properties of the resulting distillate fuel are excellent, making the product useful as a winter diesel fuel.

Hydroisomerization and hydrocracking are well known processes for upgrading hydrocarbon synthesis products and the conditions employed can vary widely. Accordingly, applicants' isomerization process may be employed in either a single stage or dual reactor system depending on the desired catalysts utilized for each reaction zone. In another embodiment of the present invention, hydroisomerization and catalytic dewaxing are conducted in a single stage, fixed bed reactor comprising a first and second reaction zone wherein a hydroisomerization catalyst and catalytic dewaxing catalyst operate to convert 10–80% of the 700° F.+ materials to 700° F.− materials and selectively dewax the feed to achieve a cold filter plugging point below about −35° C. The first reaction zone preferably comprises a first catalyst layer containing a hydroisomerization catalyst while the second reaction zone comprises a second catalyst layer containing a catalytic dewaxing catalyst or preferably containing a mixture of hydroisomerization and catalytic dewaxing catalysts. In addition, each reaction zone may contain one or more catalyst beds comprising one or more catalysts in order to incorporate interstage quench or liquid redistribution between beds. Catalyst activity for each reaction zone will normally be dependent upon variations in operating conditions. When operating in a single reactor, it is preferred to utilize hydroisomerization and catalytic dewaxing catalysts which have similar activity for the conversion and cracking of the n-paraffin containing hydrocarbon feeds under analogous operating conditions, i.e., similar or overlapping reaction conditions such as temperature and pressure. However, activity balance may be achieved by varying the degree and concentration of each of the catalysts in a single reactor or the degree and concentration of a catalyst within a particular reaction zone or catalyst bed. In the alternative, a dual reactor system may be employed to conduct hydroisomerization and catalytic dewaxing in separate reactors, connected in series, such that the total liquid product of the first reactor flows directly into the reaction zone of the second reactor. The preferred reactor conditions, i.e., temperature and pressure for each reactor, may depend on the catalysts employed in each reactor.

During hydroisomerization of the wax containing paraffinic feed, conversion of the 700° F.+ fraction to a material boiling below this range (700° F.−) will range from about 10–80%, preferably 30–70% and more preferably 30–60% based on a once through pass of the feed through the reaction zone. Table 1 below lists some broad and preferred conditions for hydroisomerization in accordance with the preferred embodiment of applicants invention.

TABLE 1

| CONDITION | BROAD RANGE | PREFERRED RANGE |
|---|---|---|
| Temperature | 400–750° F. | 600–750° F. |
| Pressure, psig | 0–2000 | 500–1200 |
| Hydrogen treat rate, SCF/B | 500–4000 | 1000–2000 |
| LHSV | 0.25–4.0 | 0.5–2.5 |

The hydroisomerization is achieved by reacting the wax containing feed with hydrogen in the presence of a suitable hydroisomerization catalyst. While many catalysts may be satisfactory for this step, some catalysts perform better than others and are preferred. For example, applicants preferred hydroisomerization catalyst comprises one or more Group VIII noble or non-noble metal components, and depending on the reaction conditions, one or more non-noble metals such as Co, Ni and Fe, which may or may not also include Group VIB metal (e.g., Mo, W) oxide promoters, supported on an acidic metal oxide support to give the catalyst both a hydrogenation and dehydrogenation function for activating the hydrocarbons and an acid function for isomerization. However, noble metals reduce hydrogenolysis, particularly at lower temperatures and will therefore be preferred for some applications. Preferred noble metals are Pt and Pd. The catalyst may also contain a Group IB metal, such as copper, as a hydrogenolysis suppressant. The cracking and hydrogenation activity of the catalyst is determined by its specific composition. The metal Groups referred to herein are those found in the Sargent-Welch Periodic Table of the Elements, copyright 1968.

The acidic support for the hydroisomerization catalyst is preferably an amorphous silica-alumina where the silica is present in amounts of less than about 30 wt %, preferably 5–30 wt %, more preferably 10–20 wt %. Additionally, the silica-alumina support may contain amounts of a binder for maintaining catalyst integrity during high temperature, high pressure processes. Typical binders include silica, alumina, Group IVA metal oxides, e.g., zirconia, titania, various types of clays, magnesia, etc., and mixtures of the foregoing, preferably alumina, silica, or zirconia, most preferably alumina. Binders, when present in the catalyst composition, make up about 5–50% by weight of the support, preferably 5–35% by weight, more preferably 20–30% by weight.

Characteristics of the support preferably include surface areas of 200–500 $m^2$/gm (BET method), preferably about 250–400 $m^2$/gm; and pore volume of less than 1 ml/gm as determined by water adsorption, preferably in the range of about 0.35 to 0.8 m/gm, e.g., 0.57 ml/gm.

The metals may be incorporated onto the support by any suitable method, and the incipient wetness technique is preferred. Suitable metal solutions may be used, such as nickel nitrate, copper nitrate or other aqueous soluble salts. Preferably, the metals are co-impregnated onto the support allowing for intimate contact between the Group VII metal and the Group IB metal, for example, the formation of bimetallic clusters. The impregnated support is then dried, e.g., over night at about 100°–150° C., followed by calcination in air at temperatures ranging from about 200°–550° C., preferably 350°–550° C., so that there is no excessive loss of surface area or pore volume.

Group VIII metal concentrations of less than about 15 wt % based on total weight of catalyst, preferably about 1–12 wt %, more preferably about 1–10 wt % can be employed. The Group IB metal is usually present in lesser amounts and may range from about a 1:2 to about a 1:20 ratio respecting the Group VIII metal.

| | |
|---|---|
| Ni, wt % | 2.5–3.5 |
| Cu, wt % | 0.25–0.35 |
| $Al_2O_3$—$SiO_2$ | 65–75 |
| $Al_2O_3$ (binder) | 25–35 |
| Surface Area, $m^2/g$ | 290–325 |
| Total Pore Volume (Hg), ml/g | 0.35–0.45 |
| Compacted Bulk Density, g/ml | 0.58–0.68 |
| Avg. Crush Strength | 3.0 min. |
| Loss on Ignition (1 hour @ 550° C.), % wt. | 3.0 max. |
| Abrasion loss @ 0.5 hr, wt % | 2.0 max. |
| Fines, wt % through 20 mesh | 1.0 max. |

Catalytic dewaxing, has as its objective, the removal of a portion of the remaining straight chain n-paraffins which contribute to undesirably high cloud point while minimizing the cracking of the branched chain iso-paraffins formed during hydroisomerization. In particular, this step removes the n-paraffins by either selectively breaking the n-paraffins into small molecules, lower-boiling liquids or converting some of the remaining n-paraffins to isoparaffins, while leaving the more branched chain isoparffins in the process stream. Catalytic dewaxing processes commonly employ zeolite dewaxing catalysts with a high degree of shape selectivity so that only linear (or almost liner) paraffins can enter the internal structure of the zeolite where they undergo cracking to effect their removal. Some preferred dewaxing catalysts include SAPO11, SAPO-41, ZSM-22, ZSM-23, ZSM-35, ZSM-48, ZSM-57, SSZ-31, SSZ-32, SSZ41, SSZ43 and ferrierite.

The catalyst(s) contained in the second reaction zone having a catalytic dewaxing functionality may comprise a catalytic dewaxing catalyst, a mixture of a catalytic dewaxing catalyst and a hydroisomerization catalyst or a composite containing a catalytic dewaxing and hydroisomerization catalyst component. In the alternative, layered catalyst beds comprising catalytic dewaxing catalyst and/or hydroisomerization catalysts may be employed in the second reaction zone. Preferably, the dewaxing catalyst comprises a composite pellet comprising both a hydroisomerization catalyst and catalytic dewaxing catalyst.

Preferably, the dewaxing component of the catalytic dewaxing catalyst comprises a 10-member ring unidirectional, inorganic oxide, molecular sieve having generally oval 1-D pores having a minor axis between about 4.2 Å and about 4.8 Å and a major axis between about 5.4 Å and about 7.0 Å as determined by X-ray crystallography. The molecular sieve is preferably impregnated with from 0.1 to 5 wt %, more preferably about 0.1 to 3 wt % of at least one Group VIII metal, preferably a noble Group VIII metal, most preferably platinum or palladium.

The isomerization component of the composite catalyst can be any of the typical isomerization catalysts, such as those comprising a refractory metal oxide support base (e.g., alumina, silica-alumina, zirconia, titanium, etc.) on which has been deposited a catalytically active metal selected from the group consisting of Group VI B, Group VII B. Group VIII metals and mixtures thereof, preferably Group VIII, more preferably noble Group VIII, most preferably Pt or Pd and optionally including a promoter or dopant such as halogen, phosphorus, boron, yttria, magnesia, etc. preferably halogen, yttria or magnesia, most preferably fluorine. The catalytically active metals are present in the range 0.1 to 5 wt %, preferably 0.1 to 3 wt %, more preferably 0.1 to 2 wt %, most preferably 0.1 to 1 wt %. The promoters and dopants are used to control the acidity of the isomerization catalyst. Thus, when the isomerization catalyst employs a base material such as alumina, acidity is imparted to the catalyst by addition of a halogen, preferably fluorine. When a halogen is used, preferably fluorine, it is present in an amount in the range 0.1 to 10 wt %, preferably 0.1 to 3 wt %, more preferably 0.1 to 2 wt % most preferably 0.5 to 1.5 wt %. Similarly, if silica-alumina is used as the base material, acidity can be controlled by adjusting the ratio of silica to alumina or by adding a dopant such as yttria or magnesia which reduces the acidity of the silica-alumina base material as taught in U.S. Pat. No. 5,254,518. Similar to the dewaxing catalyst, one or more isomerization catalysts can be pulverized and powdered, and mixed producing the second component of the composite pellet catalyst.

The composite catalyst can contain the individual powdered components which make it up in a broad ratio. Thus, the components can be present in the ratio in the range 1:100 or more to 100 or more: 1, preferably 1:3 to 3:1.

A more detailed description of this invention may be had through the following comparisons.

Two comparative examples of Fischer-Tropsch derived distillate fuels were prepared as follows:

As illustrated in FIG. 1, the multi-stage isomerization process was carried out in an isothermal sand bath (2) containing two 0.5 inch up-flow fixed bed reactors, R1 and R2, connected in series where the total liquid product of the first reactor (R1) was fed directly into the reaction zone of the second reactor (R2).

R1 contained 80 cc (44.7 gms) of a commercially available hydroisomerization catalyst comprising 0.5 wt/o Pd on a silica-alumina support containing nominally 20 wt % aluminal80 wt % silica and 30 wt % alumina binder. R2 contained a catalyst blend containing 29 cc (16.2 gms) of a commercially available dewaxing catalyst comprising 0.5 wt % Pt on an extrudate containing Theta-1 zeolite (TON) and 51 cc (27.5 gms) of the hydroisomerization catalyst contained in R1. The extrudate was crushed and the −8, +20 mesh used to load a portion of the fixed bed reactor. There was no treatment or interstage stripping of the hydroisomerized product of R1 prior to feeding into R2.

A 300° F.+ Fischer-Tropsch derived wax containing feed (4) was run through R1 at conditions that resulted in about 50% conversion of the 700° F.+ material to 700° F.− and dewaxing was run through R2 to achieve a cloud point below about −35° C. The isothermal reactor conditions were as follows: 715 psig, 1650 SCF/Bbl hydrogen treat rate at 0.854 LHSV and a temperature of approximately 606° F.

Product distribution is shown in Table 2 below. Two diesel fuels in (Fuel 1 and Fuel 2) were prepared from a 300° F.+ Fischer-Tropsch feed using the process detailed above. The feed was obtained by reacting hydrogen and CO m over a Fischer-Tropsch catalyst comprising cobalt and rhenium on a titania support. In particular, Fuel 1 comprised a 280–700° F. nominal cut fuel whereas Fuel 2 comprised a 300–700° F. nominal cut.

The process employed in the example showed boiling range product distributions characterized by high selectivity to 300/700° F. with low gas and naphtha production.

TABLE 2

| BOILING RANGE | YIELD, WT % | FUEL 1 | FUEL 2 |
|---|---|---|---|
| IBP–280° F. | 10.492 | No | No |
| 280–300° F. | 2.744 | Yes | No |
| 300–700° F. | 53.599 | Yes | Yes |
| 700–800° F. | 10.016 | No | No |
| 800° F.+ | 23.149 | No | No |

For emissions testing, the two fuels of the invention, as produced above, were compared with two conventional petroleum U.S. #2 low sulfur diesel fuels (ASTM D975-98b) referred to hence as Fuel 3 and Fuel 4. Table 3 provides a comparison of the relevant characteristics for Fuels 1 to 4.

TABLE 3

| PROPERTY | FUEL 1 | FUEL 2 | FUEL 3 | FUEL 4 |
|---|---|---|---|---|
| Density (IP-365) | .768 | .772 | .846 | .854 |
| Sulfur, % (RD 86/10) | 0 | 0 | 0.04% | .05% |
| IBP, ° C. (ASTM D-86) | 136 | 173 | 197 | 184 |
| T50, ° C. (ASTM D-86) | 252 | 257 | 294 | 288 |
| T95, ° C. (ASTM D-86) | 330 | 332 | 339 | 345 |
| Cetane (ASTM D-613) | 70.0 | 71.8 | 53.0 | 50.1 |
| Aromatics, total % (IP-391) | 0 | 0 | 27.9 | 26.7 |
| Polyaromatics, % (IP-391) | 0 | 0 | 7.1 | 6.4 |
| Cloud Point, ° C. (ASTM D-5771) | −36 | −47 | −6 | −5 |
| CFPP, ° C. (IP-309) | −46 | −46 | −7 | −18 |

Concentrations listed as "0" correspond to concentrations below the detectable limits of the test procedures delineated in Table 3. Each standard analytical technique used to determine the components of Fuels 1–4 is shown in parentheses.

By virtue of using the Fischer-Tropsch process, the recovered distillate has nil sulfur and nitrogen. Further, the process does not make aromatics and polyaromatics, or as usually operated, virtually no aromatics are produced. Accordingly, the concentration of sulfur, aromatics and polyaromatics for Fuels 1 and 2 were below the detectable limits of the test methods shown in Table 3.

Although there is not standard specific temperature requirement for cloud point, or cold filter plugging point, all fuels must meet the low temperature requirements for the markets in which they are sold. These requirements not only differ from region to region, but are also seasonally dependent. The tenth percentile minimum temperatures are listed in the ASTM Standard Specification for Diesel Fuel Oils D-975 in FIGS. X4.1–X4.12. These ambient air temperatures were derived from an analysis of historical hourly temperature readings recorded over a period of 15 to 21 years from 345 weather stations across the United States. The tenth percentile minimum ambient air temperature is defined as the lowest ambient air temperature which will not go lower on average more than 10% of the time. In other words, the daily minimum ambient air temperature would, on average, not be expected to go below the monthly tenth percentile minimum ambient air temperature more than three days for a 30 day month.

In accordance with this listing, all requirements for the continental United States from summer through October (FIG. X4.1) are met with a target of −15° C. cloud point (i.e. a summer diesel). A winter diesel with the cloud point of −35° C. meets all requirements for the continental United States for January (FIG. X4.4) including the Southern region of Alaska (FIG. X4.10).

As illustrated in Table 3, the Fischer-Tropsch derived fuels of this invention have cloud points below −35° C., thereby qualifying as a winter diesel fuel.

Engine Testing

For comparison, the Fischer-Tropsch fuels of the invention (Fuels 1 and 2) were compared with the conventional petroleum fuels. The fuels were evaluated with a Peugeot 405 Indirect Injection (IDI) light duty diesel engine. Regulated emissions were measured during hot-start transient cycles and emissions of hydrocarbons (HC), carbon monoxide (CO), nitrous oxide (NOx) mn and particulate matter (PM) were measured. The results are summarized in Table 4 below. Test data is represented as the absolute value in gm/Hp-hr which is followed by the percent change for each emission value verses the base, Fuel 4; a conventional petroleum diesel fuel. All fuels were run through the combined to Urban Drive Cycle and Extra Urban Drive Cycle (commonly known as ECE-EUDC respectively) hot and cold test protocols in duplicate in a randomized design.

The light duty European test cycle is performed in two parts:

ECE: this urban cycle represents inner city driving conditions after a cold start with a maximum speed of 50 km/h, and EUDC: the extra-urban driving cycle is typical of suburban and open road driving behavior and includes speeds up to 120 km/h. The data is based on the combined emissions of the ECE and EUDC cycles expressed in g/km. See SAE Papers 961073 and 961068.

Fuel 4 was used as the reference and therefore run in triplicate; all others were run in duplicate. The data represents the average values from the combination of the ECE-EUDC test procedures ("combined ECE-EUDC" reporting method).

TABLE 4

| | HC | Delta | NOx | Delta | CO | Delta | PM | Delta |
|---|---|---|---|---|---|---|---|---|
| Fuel 1 | 0.055 | −53.9% | 0.541 | −19.1% | 0.354 | −51.9% | 0.029 | −62.6% |
| Fuel 2 | 0.051 | −57.1% | 0.543 | −18.8% | 0.358 | −51.4% | 0.031 | −59.1% |
| Fuel 3 | 0.103 | −12.5% | 0.644 | −3.4% | 0.650 | −11.6% | 0.076 | −1.5% |
| Fuel 4 | 0.118 | basis | 0.669 | basis | 0.736 | basis | 0.077 | basis |

The data revealed significantly lower emissions produced from applicants Fischer-Tropsch fuels than observed with either of the conventional diesel fuels (Fuels 3 and 4). In particular, applicants Fuel 1 produced emissions with a 53.9% decrease in hydrocarbons, 51.9% decrease in carbon monoxide, 19.1% decrease in nitrogen oxides and 62.6% decrease in particulate matter as compared to the base conventional diesel fuel. However, a closer review of the data shows that the fuels of this invention have a substantial advantage in particulates and nitrogen oxides emissions above that which would normally be expected. In this regard, it is well known in the art that the most critical emissions parameter for a diesel fuel is the PM-NOx tradeoff, i.e., there is a known inverse relationship between particulate matter and NOx; see SAE 961074 and 961075. Decreasing one variable will normally result in increasing the other variable. The fuels of this invention provide substantially reduced values of both PM and NOx emissions.

Table 5 below details the predicted changes for light duty (i.e., passenger car) diesel engines according to the well recognized European Program on Emissions, Fuels and Engine Technologies (EPEFE) study in Europe undertaken by the government, auto and oil companies to define the relationship between fuel properties and emissions based on variables in density, cetane number and T95. SAE Paper 961073, Tables 3 through 6. The left hand column indicates the two pollutants (particulate matter and nitrogen oxides) along with the changes in absolute emissions in g/Hp-hr and percent change (% increase(positive) or % decrease (negative)) for each of the four fuel characteristics shown at the top of the columns. The emission change (in g/Hp-hr and percent) is based on a deviation of one of the four fuel characteristics as shown in parenthesis. For example, if the T95 was lowered by 55° C., the particulate emissions would decrease by 6.9% while the NOx would increase by 4.6%.

TABLE 5

| | Density (−0.027) | Polyaromatics (−7%) | Cetane (+8 numbers) | T95 (−55 C) |
|---|---|---|---|---|
| Particulate | | | | |
| g/Hp-hr | −0.012 | −0.003 | 0.003 | −0.004 |
| % | −19.4% | −5.2% | 5.2% | −6.9% |
| NOx | | | | |
| g/Hp-hr | 0.008 | −0.019 | −0.001 | 0.026 |
| % | 1.4% | −3.4% | −0.2% | 4.6% |

Table 6 below was produced by combining the published results of Table 5, with the properties measured in Table 3 and the emissions results of Table 4. The resulting test data indicates the expected change in emissions as projected by the EPEFE equations versus the actual changes measured during emissions testing on each of the fuels listed in Table 3. Again, all results are referenced to Fuel 4 as the base fuel.

TABLE 6

| Pollutant | | Fuel 3 vs. 4 | Fuel 2 vs. 4 | Fuel 1 vs. 4 |
|---|---|---|---|---|
| Particulate | Projected | −3.9% | −55.1% | −51.3% |
| | Actual | −1.5% | −59.1% | −62.6% |
| NOx | Projected | 1.2% | 2.2% | 1.8% |
| | Actual | −3.4% | −18.8% | −19.1% |

Fuel 3 shows very close agreement with the predictions differing by only a slight amount with particulate emissions 2.4% (¯3.9%–¯1.5%) worse than expected and NOx 4.6% (1.2%–¯4.3%) better than expected. For Fuels 1 and 2, the contrast from Fuel 4 is quite different and unexpected. In both cases, the Fischer-Tropsch derived fuels of this invention exceeded the performance predicted for particulate emissions while at the same time dramatically decreasing NOx emissions. According to these projections, an improvement in particulate emissions is expected for Fuels 1 and 2 and the above data not only bears this prediction out but exceeds it. In addition, the EPEFE predictions also predict a slight increase in NOx. However, in contrast to this prediction, the data reveals that applicants' diesel fuels resulted in a substantial decrease in the NOx emissions. Thus, the diesel fuels of this invention simultaneously result in both large NOx and particulate emissions reductions. Such results are unexpected and directly contradictory to the well recognized correlations.

Lastly, the Fischer-Tropsch derived fuels of this invention also display unusually good smoke results. A standard BOSCH smoke test (BOSCH T100 free acceleration smoke test) correlated with startup hydrocarbon emissions and hydrocarbon emissions during hard accelerations was performed using the four comparative fuels from Table 3. The results are in Table 7 below.

TABLE 7

| | |
|---|---|
| Fuel 1: | 0 |
| Fuel 2: | 0 |
| Fuel 3: | 2.02 |
| Fuel 4: | 2.07 |

For the Fischer-Tropsch derived fuels of this invention, the smoke level was below the detectable amount.

The citations of the several SAE papers referenced herein are:

P. Gadd, K. P. Schindler, D. Hall, "*European Programme on Emissions, Fuels and Engine Technologies (EPEFE)-Light Duty Diesel Study*" SAE Paper 961073.

H. J. Stein, N. G. Elliot, J. P. Pochic, "*European Programme on Emissions, Fuels and Engine Technologies (EPEFE)-Vehicle and Engine Testing Procedures*" SAE Paper 961068.

D. J. Rickeard, R. Bonetto, M. Signer, "*European Programme on Emissions, Fuels and Engine Technologies (EPEFE)-Comparison of Light and Heavy Duty Diesel Studies*", SAE Paper 961075.

M. Singer, P. Heinze, R. Mercogliano, H. J. Stein, "*European Programme on Emissions, Fuels and Engine Technologies (EPEFE)-Heavy Duty Diesel Study*" SAE Paper 961074.

What is claimed is:

1. A process for producing a fuel comprising contacting in a first reaction zone a feed comprising a 300° F.+ Fischer-Tropsch derived fraction and hydrogen or a hydrogen containing gas with a first catalyst comprising a hydroismerization catalyst to form a first zone effluent and contacting in a second reaction zone at least a portion of the liquid product from the first zone effluent with a second catalyst comprising a catalytic dewaxing molecular sieve catalyst with monodimensional channels containing 10 member rings to form a second zone effluent comprising an isomerized hydrocarbon product.

2. The process of claim 1, wherein the catalytic dewaxing catalyst is selected from the group consisting of SAPO-11, SAPO-41, ZSM-22, ZSM-23, ZSM-48, ZSM-57, SSZ-31, SSZ-32, SSZ-41, and SSZ-43, and wherein the process further comprises recovering a middle distillate product boiling in the range of diesel fuel from said second zone effluent.

3. The process of claim 2 wherein said middle distillate product is useful as a winter diesel fuel or a blending component therefor.

4. The process of claim 3 wherein said middle distillate boils in the range of 320–700° F.

5. The process of claim 1 wherein said second reaction zone further comprises a hydroisomerization catalyst.

6. The process of claim 1 wherein said catalytic dewaxing catalyst comprises a composite pellet catalyst comprising a hydroisomerization catalyst and a catalytic dewaxing catalyst.

7. A process according to a claim 3 wherein said second reaction zone further comprises at least one catalyst bed comprising a hydroisomerization catalyst, a catalytic dewaxing catalyst or a mixture thereof.

8. A process according to claim 1 wherein said reaction zone comprises at least one catalyst bed comprising a hydroisomerization catalyst.

9. The process of claim 2 wherein the first reaction zone converts 10–80% of 700° F.+ hydrocarbons to 700° F.− hydrocarbons and the second reaction zone catalytically dewaxes the product of the first reaction zone to a cloud point of less than about −31° F.

10. The process of claim 2 wherein the first reaction zone converts 30–70% of 700° F.+ hydrocarbons to 700° F.− hydrocarbons and the second reaction zone catalytically dewaxes the product of the reaction zone to a cloud point of less than about −40° F.

11. The process of claim 10 wherein the first reaction zone converts 40–60% of 700° F.+ hydrocarbons to 700° F. hydrocarbons.

12. The process of claim 1 wherein the first reaction zone and the second reaction zone are contained in the same reaction vessel such that the total liquid product from the first zone effluent is passed into the second reaction zone.

13. The process of claim 12 wherein the reactor conditions comprise a temperature of about 400° F. to about 750° F., pressures of up to about 2000 psig, space velocity of about 0.25 to about 4.0 LHSV and a hydrogen gas treat ratio of about 500–4000 SCF/Bbl.

14. The process of claim 12 wherein the reactor conditions comprise a temperature of about 600° F. to about 750° F. pressures of about 500 to about 1200 psig, space velocity of about 0.5 to about 2.5 LHSV and a hydrogen gas treat rate of about 1000–2000 SCF/Bbl.

15. The process of claim 1 wherein the hydroisomerization catalyst in the first reaction zone comprises less than about 15 wt % of Group VII metal component(s) based on the total weight of the catalyst and a Group IB; Group VIII metal ratio of less than 1:2 supported on an amorphous silica-alumina carrier having less than about 30 wt % silica, the carrier having a surface area of greater than about 200 $m^2$/gm and a pure volume of less than about 1.0 ml/gm.

16. The process of claim 15 wherein said Group VIII metal component consists of palladium (Pd), platinum (Pt) or a mixture thereof.

17. The process of claim 5 wherein the catalytic dewaxing catalyst in the second reaction zone is selected from the group consisting of SAPO-11, SAPO-41, ZSM-22, ZSM-23, ZSM-48, ZSM-57, SSZ-31, SSZ-32, SSZ-41, and SSZ-43.

18. The process of claim 1 wherein said Fischer-Tropsch process is a distilling process comprising a cobalt catalyst.

19. A fuel comprising a Fischer-Tropsch derived hydrocarbon distillate that was treated with at least one of hydrotreating and hydroisomerization having 464° F.≦T95≦662° F. and a cold filter plugging point below about −31° F.

20. A fuel comprising a Fischer-Tropsch derived hydrocarbon distillate that was treated with at least one of hydrotreating and hydroisomerization, having 473° F.≦T95≦644° F. and a cold filter plugging point below about −31° F.

21. A fuel comprising a Fischer-Tropsch derived hydrocarbon distillate that was treated with at least one of hydrotreating and hydroisomerization, having 473° F.≦T95≦635° F. and a cold filter plugging point below about −31° F.

22. A fuel according to claims 19, 20, or 21 having a cold filter plugging point below about −40° F.

23. A fuel according to claims 19, 20, or 21 wherein the fuel contains:

≦10 wppm sulfur

≦10 wppm nitrogen

≦10 wt % aromatics and has a cetane number greater than about 65.

24. A fuel according to claims 19, 20, or 21 wherein the fuel contains:

≦1 wppm sulfur

≦1 wppm nitrogen

≦0.1 wt % aromatics and has a cetane number greater than about 70.

25. A process for producing a fuel useful as a diesel fuel which process is conduced in a single reaction vessel comprising two reaction zones comprising:

(a) contacting in a first reaction zone a feed comprising a 300° F.+ Fischer-Tropsch derived distillate fraction and hydrogen or a hydrogen containing gas with a first catalyst comprising a hydroisomerization catalyst to form zone effluent, and (b) passing said total first zone effluent into a second reaction zone comprising a hydroprocessing catalyst selected from the group consisting of hydrocracking catalyst, hydroisomerization catalyst and mixtures thereof, wherein at least one hydroprocessing catalyst is selected from the group consisting of SAPO-11, SAPO-41, ZSM-22, ZSM-23, ZSM-48, ZSM-57, SSZ-11, SSZ-32, SSZ-41, and SSZ-43, to form a second zone effluent comprising an isomerized hydrocarbon product.

26. The process of claim 25 further comprising recovering a middle distillate product boiling in the range of diesel fuel from said second zone effluent.

27. A process according to claim 26 wherein said middle distillate boils in the range of 320–700° F.

28. The process of claim 26 wherein the first zone converts 10–80% of 700° F.+ hydrocarbons to 700° F.− hydrocarbons and the second zone catalytically dewaxes the product of the first zone to a cloud point of less than about −31° F.

29. The process of claim 28 wherein the first zone converts 30–70% of 700° F.+ hydrocarbons to 700° F.− hydrocarbons and the second zone catalytically dewaxes the product of the first zone to a cloud point of less than about −40° F.

30. The process of claim 29 wherein the first zone converts 40–60% of 700° F.+ hydrocarbons to 700° F.− hydrocarbons.

31. The process of claim 26 wherein said middle distillate is further blended with a conventional petroleum derived fuel and wherein said middle distillate comprises at least 10% of the blend.

32. The process of claim 26 wherein said 300° F.+ fraction is derived from a Fischer-Tropsch hydrocarbon synthesis, in which a synthesis gas comprising a mixture of $H_2$ and CO react in the presence of a suitable Fischer-Tropsch hydrocarbon synthesis catalyst to form a hydrocarbon product.

33. The process of claim 32 wherein said Fischer-Tropsch process is a non-shifting Fischer-Tropsch process comprising a cobalt catalyst.

* * * * *